US005887215A

United States Patent [19]

Earle et al.

[11] Patent Number: 5,887,215

[45] Date of Patent: Mar. 23, 1999

[54] PHOTOGRAPHIC PROCESSING APPARATUS

[75] Inventors: Anthony Earle, Harrow Weald; Leslie Wells, Ealing; Mark McLennan, Garston, all of England

[73] Assignee: Eastman Kodak Company, Rochester, N.Y.

[21] Appl. No.: 881,831

[22] Filed: Jun. 25, 1997

[51] Int. Cl.[6] ..... G03D 13/10

[52] U.S. Cl. ..... 396/651; 226/92

[58] Field of Search ..... 396/612, 646, 396/647, 651, 652; 355/27–29; 226/91, 92, 96; 156/353, 361, 461

[56] References Cited

U.S. PATENT DOCUMENTS

| | | | |
|---|---|---|---|
| 3,601,299 | 8/1971 | Murer et al. | 226/96 |
| 3,853,688 | 12/1974 | Onishi et al. | 156/461 |
| 4,067,035 | 1/1978 | Plursch et al. | 396/599 |
| 4,279,371 | 7/1981 | Laar et al. | 226/91 |
| 4,368,969 | 1/1983 | Baschung | 396/646 |
| 4,411,725 | 10/1983 | Siegel et al. | 156/353 |
| 4,561,924 | 12/1985 | Hope et al. | 156/361 |
| 5,060,009 | 10/1991 | Milovanovich | 355/27 |
| 5,455,652 | 10/1995 | Earle et al. | 396/612 |

FOREIGN PATENT DOCUMENTS

| | | |
|---|---|---|
| 0679594A2 | 4/1995 | European Pat. Off. . |

*Primary Examiner*—D. Rutledge
*Attorney, Agent, or Firm*—Frank Pincelli

[57] ABSTRACT

Described herein is a clip arrangement for use in processing apparatus which have at least one continuous leader belt running therethrough for driving photographic material to be processed through the apparatus, the clip arrangement connecting the material to the leader belt. The clip arrangement comprises an adhesive element which secures the material to the belt.

6 Claims, 3 Drawing Sheets

PHOTOGRAPHIC PROCESSING APPARATUS

FIELD OF THE INVENTION

The present invention relates to photographic processing apparatus and is more particularly concerned with clips for use in such apparatus having leader belts for driving the material being processed therethrough.

BACKGROUND OF THE INVENTION

In large processing machines, one or more continuous leader belts are provided for transporting the photographic material to be processed, for example, photographic paper, along a processing path through the machine. These leader belts are located to one side of the processing path so as not to interfere with the movement of the photographic material along the processing path. The leading end of the paper or other photographic material to be processed is attached to the moving leader belt by means of a metal clip. The clip is attached to the belt, as it is moving, so that it is transported therewith, the paper or photographic material having been already threaded through the clip.

When the clip is attached to the leader belt, it grips the belt so that it is held in a bowed or buckled configuration. This means that the belt is always deformed in regions where it is gripped by clips. Moreover, it may be difficult to grasp the moving belt so that the clip can be attached.

Furthermore, with the recent trend to reduce the amount of processing solution used when processing photographic material, large processing machines, of the type described above, have been adapted to operate with lower volumes of processing solution. In order to obtain the lower volumes, the width of the processing tanks in such machines need to be substantially reduced so that the material passes through a narrow processing channel which defines the processing path. This means that there is less clearance for the clip carrying the material to pass along the processing path as it is taken through the machine by the leader belt. As a result, the clip can come off the belt and/or jam in the narrow processing channel. The material being processed may also tear as result of the clip detaching itself from the belt or jamming in the processing channel.

When these problems occur, the machine has to be stopped so that the clip and/or material can be recovered from the machine. This results in lost processing time, particularly if the machine is a multi-strand machine capable of processing several strands of material at one time. Moreover, components in the machine may need to be removed therefrom so that access to the clip and paper can be obtained, many of the components being heavy and difficult to lift.

Furthermore, clips as known in the art cause damage to the leader belt if they are not attached correctly or if they become dislodged from an optimum position on the belt.

SUMMARY OF THE INVENTION

It is, therefore, an object of the present invention to provide an improved clip arrangement which overcomes the problems described above.

In accordance with one aspect of the present invention, there is provided photographic processing apparatus for processing photographic material, the apparatus comprising a plurality of processing stages through which the material passes along a processing path therethrough as it is processed, and at least one leader belt to which the material is attached for transportation along the processing path, characterized in that the apparatus includes an adhesive clip arrangement for attaching the material to the leader belt.

By using an adhesive clip arrangement, it is possible to attach the clip and material to be processed to the belt as the belt is moving, for example, at a speed of up to around 50 $mmin^{-1}$ without damaging the belt.

Furthermore, if the clip arrangement becomes detached during processing, the material can simply be pulled clear of the machine without having to stop it or remove any of the components.

Advantageously, as the adhesive clip arrangement is thin and flexible, it can easily be deformed as it passes around rollers and through squeegees as it is transported along the processing path. The use of such clip arrangements also means that squeegee rollers can readily be employed as there is no risk of the rollers becoming damaged as the clip arrangements pass through them. Existing stationary blade squeegees are also subject to less damage.

Adhesive clip arrangements also have the advantage that leader belt life can be extended.

By using adhesive clip arrangements, it will also be possible to reduce the amount of processing solution carried over from one processing tank to the next.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
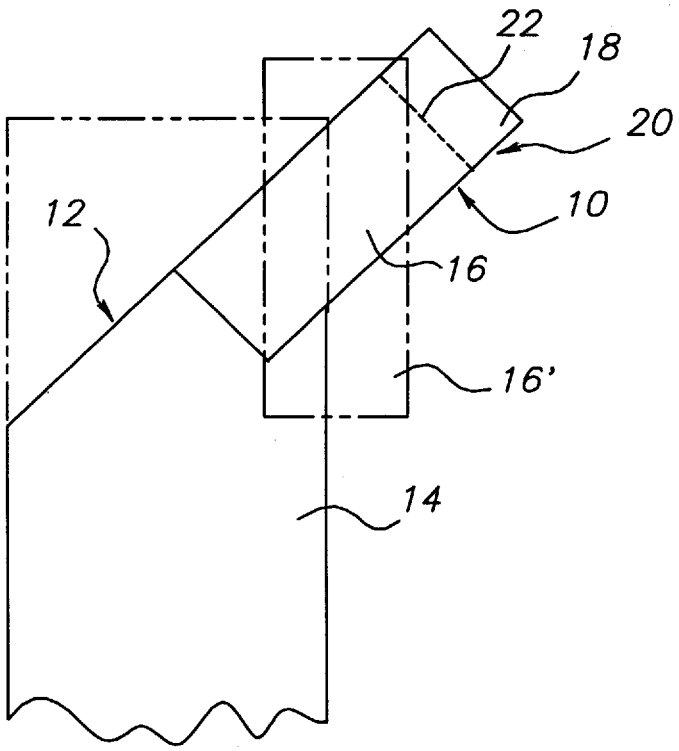
FIG. 1 is a plan view of an adhesive clip arrangement in accordance with the present invention attached to a strip of photographic paper.
Figure 2:
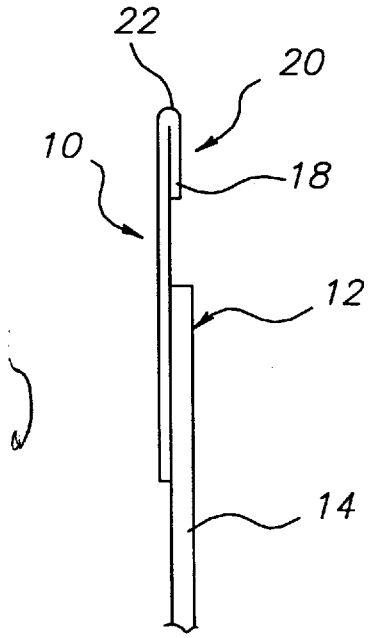
FIG. 2 is a side elevational view of the clip arrangement shown in FIG. 1.

FIGS. 1 and 2 show an adhesive clip arrangement 10 attached to one end 12 of an elongate strip of photographic material 14. The end 12 is trimmed back as shown so that it can form a leading end for the material as it is transported through a processing machine (not shown). The clip arrangement 10 comprises an elongate piece of adhesive tape 16 which is attached to the leading end 12 of the material 14, as is shown more clearly in FIG. 1, and has a pull off tag portion 18 formed at a free end 20. Free end 20 is folded back on itself along line 22 (as shown in FIG. 2), the tag portion 18 being provided on the same side of the tape 16 as that which is attached to the material 14.

Figure 3:
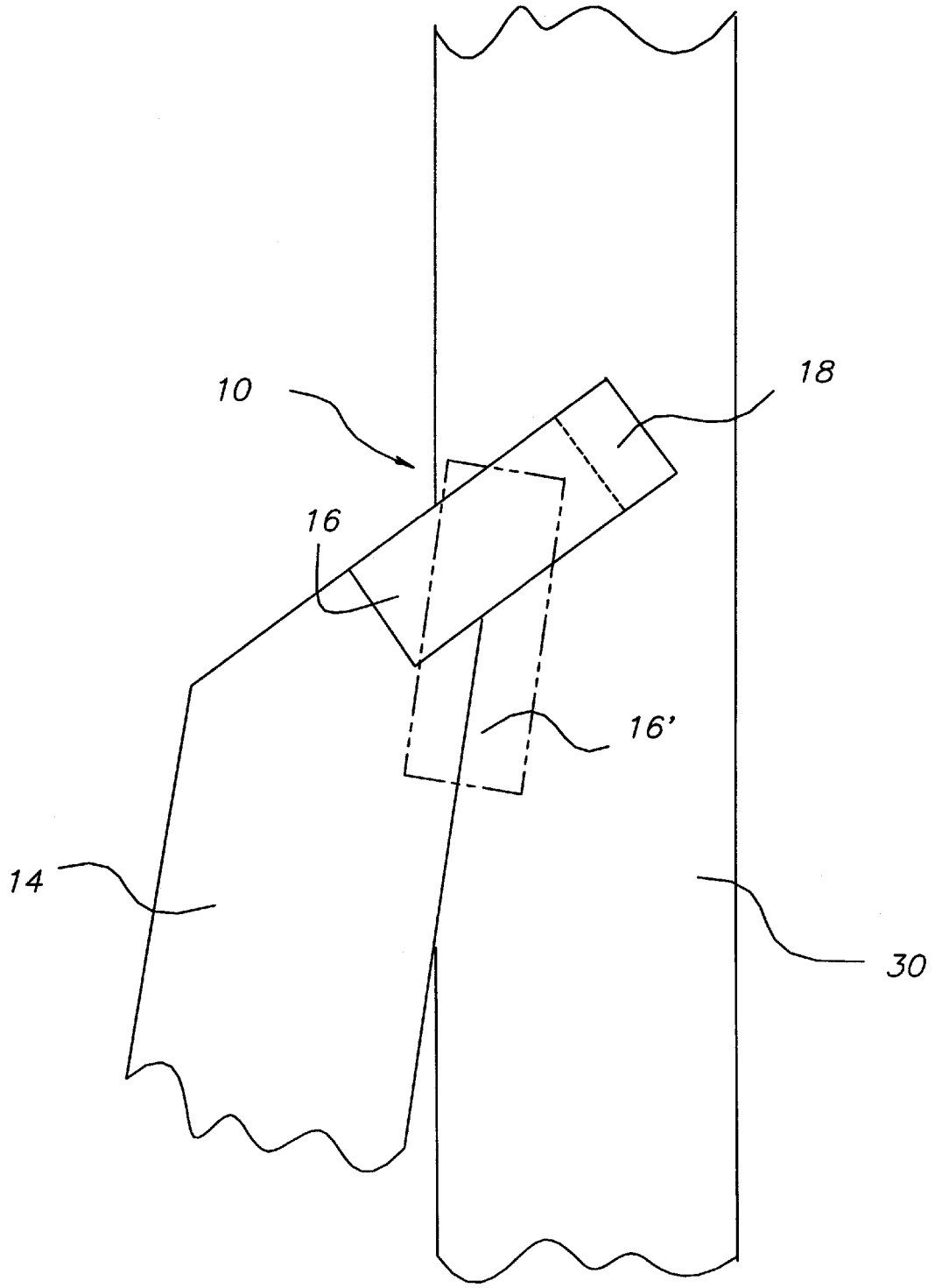
FIG. 3 is a plan view illustrating an adhesive clip arrangement connecting a strip of photographic paper to a leader belt.

In FIG. 3, a leader belt 30 is shown which has a strip of photographic material 14 attached thereto by means of an adhesive clip arrangement 10 in accordance with the present invention. Parts which have already been described are reference the same. As shown, the leading end 12 of the material 14 is twisted across the belt 30 so that the adhesive clip arrangement 10 attached to it can be attached to the belt 30. It has been found that the material 14 straightens out from this twisted position at the leading end 12 as it is transported along the processing path.

It has been found that, at the end of processing, tag portion 18 of the clip arrangement 10 stands upright away from the surface of the leader belt 30 and can easily be grasped to remove the material 14 from the belt 30.

It is not necessary that the adhesive clip be attached to the photographic material at an angle as shown in FIGS. 1 and 3. It is also possible to attach the adhesive clip so that it is substantially parallel to the edge of the material as indicated by adhesive clip 16' as shown by chain lines in FIGS. 1 and 3.

It is important that there is no photographic material which extends beyond the adhesive clip arrangement. This is because such material will not easily be guided around rollers and will tend to cause the clip arrangement 10 to become detached from the belt 30 or cause the material to tear.

Figure 4:
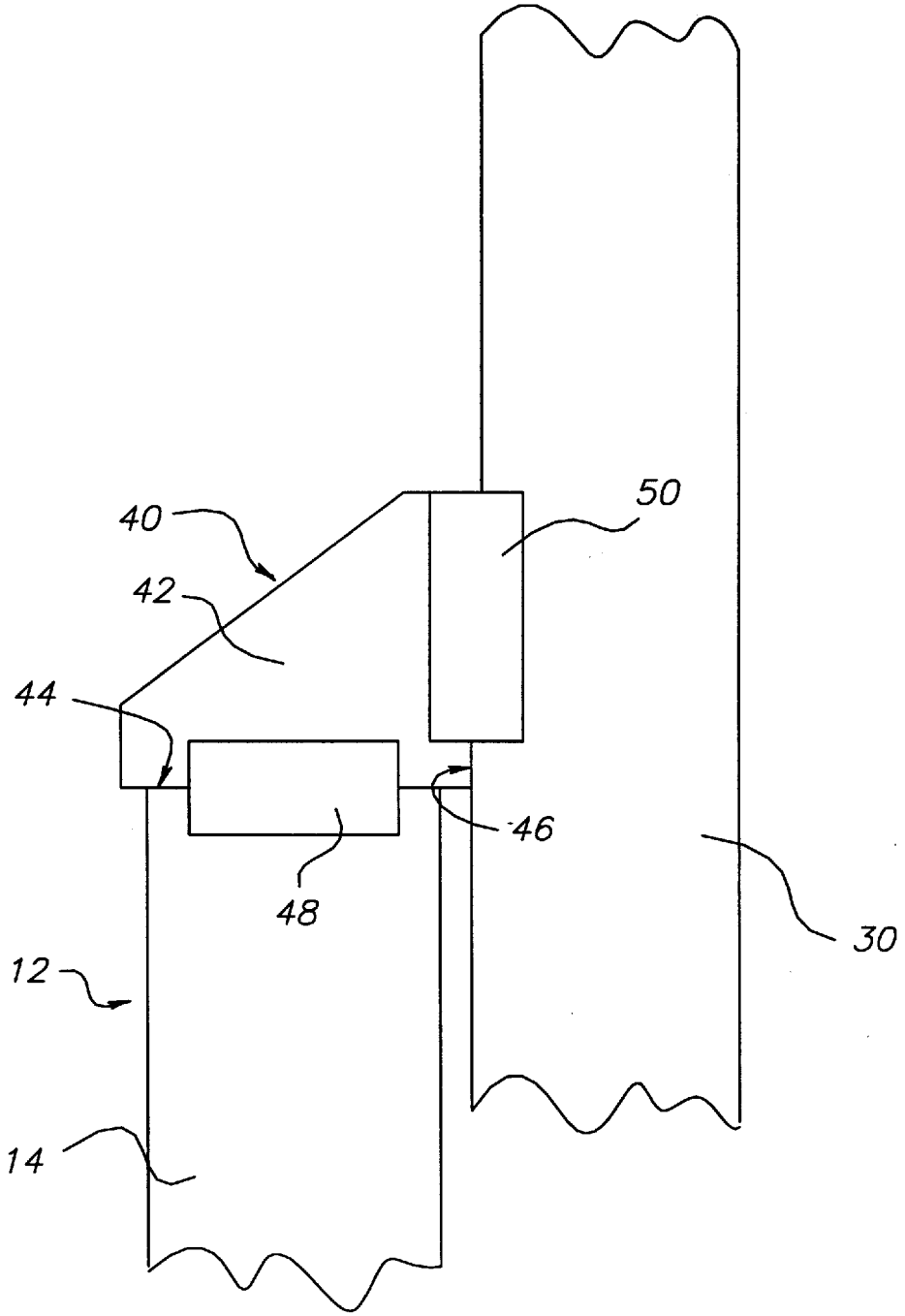
FIG. 4 illustrates another embodiment of an adhesive clip arrangement in accordance with the present invention.

FIG. 4 illustrates another embodiment of an adhesive clip arrangement 40 in accordance with the present invention for attaching photographic material 14 to a leader belt 30. Parts which have already been described are referenced the same. The clip 40 comprises a body portion 42 which is generally triangular in shape having perpendicular edges 44,46. The body portion 42 carries adhesive tape strips 48,50 at respective edges 44,46 for attachment to the belt 30 and to the material 14 as shown. This embodiment provides an offset so that the material 14 can be pulled through the machine without any bends or kinks formed in its leading end 12. As shown, edges 44,46 of the body portion 42 are aligned with leading end 12 and belt 30 so that there is no exposed adhesive on tape strips 48,50 which can interfere with the progress of the material along the processing path.

The body portion 42 may be arranged so that it overlaps the belt 30 along edge 46 (not shown), and a small slot (also not shown) may be provided in the body portion 42, close to edge 44 and transverse to edge 46, so that the belt 30 can be inserted therein for further support. This helps to prevent the body portion 42 from twisting with respect to the belt 30 as drag on the belt 30 is increased due to the presence of the photographic material 14 attached thereto.

It will be readily appreciated that the leading end 12 of the material 14 can easily be folded over (not shown) to form a triangular shape as shown in FIG. 4 for attachment to the belt 30. In this case, care needs to be taken that processing solution cannot be trapped in the fold as the material 14 is transported along the processing path.

In all the embodiments described above, the adhesive tape strips may comprise any suitable tape, such as, splicing tape.

It will be readily appreciated that adhesive clips in accordance with the present invention can also be used to advantage in standard processing machines having leader belts, the life of the belt being prolonged as the clip is not distorting the belt in the region where it is attached.

It is to be understood that various other changes and modifications may be made without departing form the scope of the present invention, the present invention being limited by the following claims.

PARTS LIST

| | |
|---|---|
| 10 | clip arrangement |
| 12 | leading end |
| 14 | photographic material |
| 16 | adhesive tape |
| 16' | adhesive clip |
| 18 | pull off tag portion |
| 20 | free end |
| 22 | line |
| 30 | leader belt |
| 40 | clip arrangement |
| 42 | body portion |
| 44, 46 | perpendicular edges |
| 48, 50 | adhesive tape strips |

What is claimed is:

1. A photographic processing apparatus for processing photographic material, the apparatus comprising a plurality of processing stages through which the material passes along a processing path as it is processed, and at least one leader belt to which the material is attached at the leading end thereof for transportation along the processing path, characterized in that the apparatus includes an adhesive clip arrangement for attaching the material to the belt, at least part of the clip arrangement comprising a strip of adhesive tape.

2. An apparatus according to claim 1, wherein the whole clip arrangement comprises a strip of adhesive tape.

3. An apparatus according to claim 1, wherein the clip arrangement comprises a strip of adhesive tape and a body portion connectable to both the leader belt and the material to be processed.

4. An apparatus according to claim 3, wherein the body portion includes two substantially perpendicular edges, the material being attached to one edge and the leader belt to the other.

5. An apparatus according to claim 2, wherein the adhesive tape comprises splicing tape.

6. An apparatus according to claim 1, further including squeegee rollers for removing excess processing solution from the belt and material as it passes from one processing stage to the next along the processing path.

* * * * *